US005183022A

United States Patent [19]

Cook

[11] Patent Number: 5,183,022

[45] Date of Patent: Feb. 2, 1993

[54] MULTI-SLOPE CANISTER PURGE SOLENOID VALVE

[75] Inventor: John E. Cook, Chatham, Canada

[73] Assignee: Siemens Automotive Limited, Chatham, Canada

[21] Appl. No.: 730,728

[22] Filed: Jul. 16, 1991

[51] Int. Cl.[5] ..... F02M 33/02

[52] U.S. Cl. ..... 123/520; 123/516

[58] Field of Search ..... 123/518, 519, 520, 521, 123/463, 516

[56] References Cited

U.S. PATENT DOCUMENTS

| | | | |
|---|---|---|---|
| 3,518,977 | 7/1970 | Smith | 123/520 |
| 3,703,165 | 11/1972 | Hansen | 123/518 |
| 4,343,281 | 8/1982 | Uozumi | 123/519 |
| 4,593,672 | 6/1986 | Barone | 123/518 |
| 4,700,750 | 10/1987 | Cook | 123/518 |
| 4,901,974 | 2/1990 | Cook et al. | 251/129.15 |
| 4,944,276 | 7/1990 | Hoose | 123/520 |
| 5,069,188 | 12/1991 | Cook | 123/518 |
| 5,083,546 | 1/1992 | Detweiler | 123/520 |
| 5,117,797 | 6/1992 | Telep | 123/519 |

FOREIGN PATENT DOCUMENTS

| | | | |
|---|---|---|---|
| 3802664 | 10/1988 | Fed. Rep. of Germany | 123/520 |

*Primary Examiner*—Carl S. Miller

*Attorney, Agent, or Firm*—George L. Boller; Russel C. Wells

[57] ABSTRACT

A multi-slope canister purge solenoid (CPS) valve has a diaphragm-controlled valve downstream of the solenoid-actuated valve. The diaphragm-controlled valve has two diaphragms that between themselves define a chamber space that is communicated to intake manifold vacuum. One of the two diaphragms is exposed to atmospheric pressure while the other is exposed to the interior of the CPS valve.

12 Claims, 2 Drawing Sheets

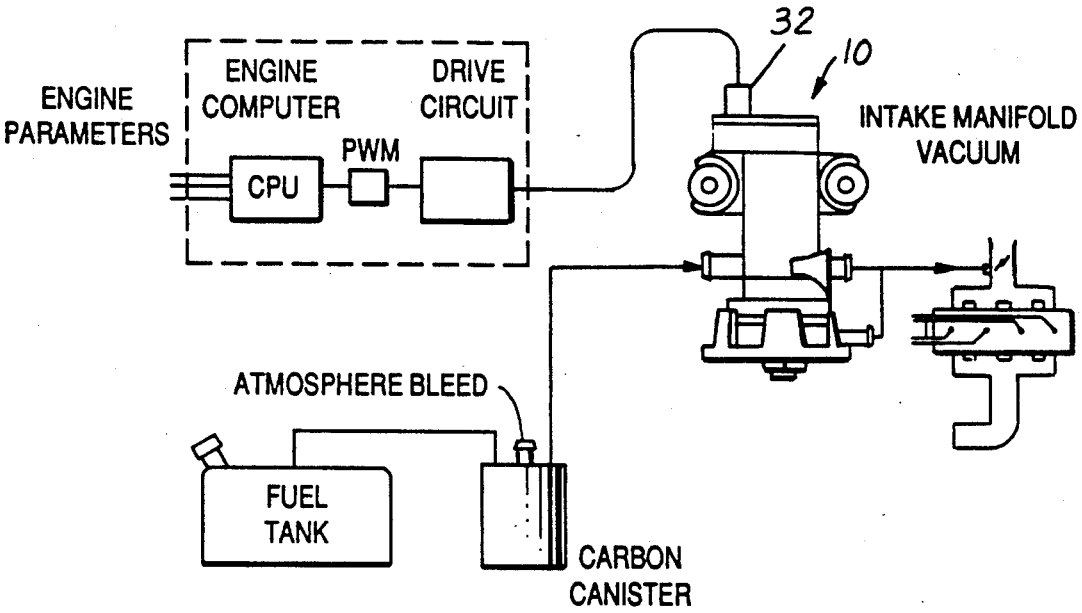
FIG.2
FIG.3
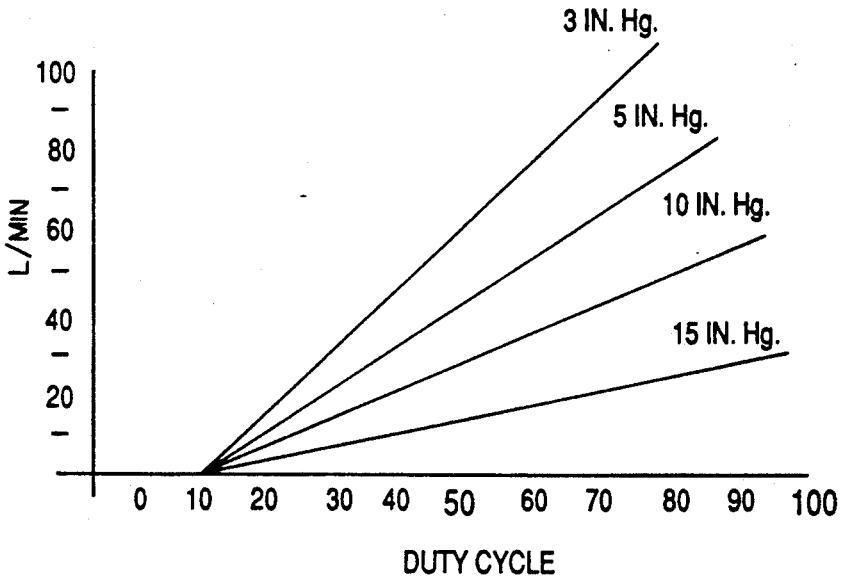

MULTI-SLOPE CANISTER PURGE SOLENOID VALVE

FIELD OF THE INVENTION

This invention relates to canister purge solenoid valves that are used in the evaporative emission control systems of automotive internal combustion engines to control the purging of canister-collected fuel vapors to the intake manifolds.

BACKGROUND AND SUMMARY OF THE INVENTION

An example of a known canister purge solenoid (CPS) valve is shown in commonly assigned U.S. Pat. No. 4,901,974. While the CPS valve shown in that patent is not a regulated CPS valve, a regulated version is known and includes a pressure regulator disposed between the valve's outlet and the solenoid-controlled valve element. The pressure regulator comprises a diaphragm that is spring-biased away from a seat toward a non-restricting condition, but is selectively positionable relative to the seat to selectively restrict the purge flow to the valve outlet. The pressure regulator functions such that as the intake manifold vacuum changes, the restriction that is imposed on the purge flow by the pressure regulator also changes, but in such a way that the manifold vacuum change has no substantial effect on the solenoid-controlled purge flow. In this way, the electrical control signal that is applied to the CPS valve's solenoid exercises full control over the purge flow substantially independently of changes in the manifold vacuum that is present at the CPS valve's outlet.

Another example of a CPS valve is shown in DE 3802664. While the CPS valve of that patent has a diaphragm-controlled valve between the valve's outlet and the solenoid-controlled valve element, it operates in a diverse manner from the regulated version of the CPS valve of U.S. Pat. No. 4,901,974 in that it deliberately strives to change the purge flow in response to manifold vacuum changes at the valve's outlet.

The present invention relates to a new and improved multi-slope CPS valve. The multi-slope feature refers to the ability of the valve to operate along any selected one of a number flow-rate vs. duty-cycle slopes, each of which defines the flow-rate vs. duty-cycle function for a corresponding intensity of intake manifold vacuum. The presently preferred embodiment of the multi-slope CPS valve of the present invention which will be described in the ensuing Description of the Preferred Embodiment is characterized by a construction and arrangement which is quite cost-effective in relation to the regulated CPS valve referred to above because it can be made by converting a regulated CPS valve by using only a few additional parts.

The foregoing features, advantages, and benefits of the invention, along with additional ones, will be seen in the ensuing description and claims which are accompanied by drawings. The drawings disclose a presently preferred embodiment of the invention according to the best mode contemplated at the present time for carrying out the invention.

BRIEF DESCRIPTION OF THE DRAWING

FIG. 2 is a schematic diagram of an evaporative emission control system containing the multi-slope CPS valve of FIG. 1.

FIG. 3 is a graph plot that illustrates the multi-slope feature.

DESCRIPTION OF THE PREFERRED EMBODIMENT

Figure 1:
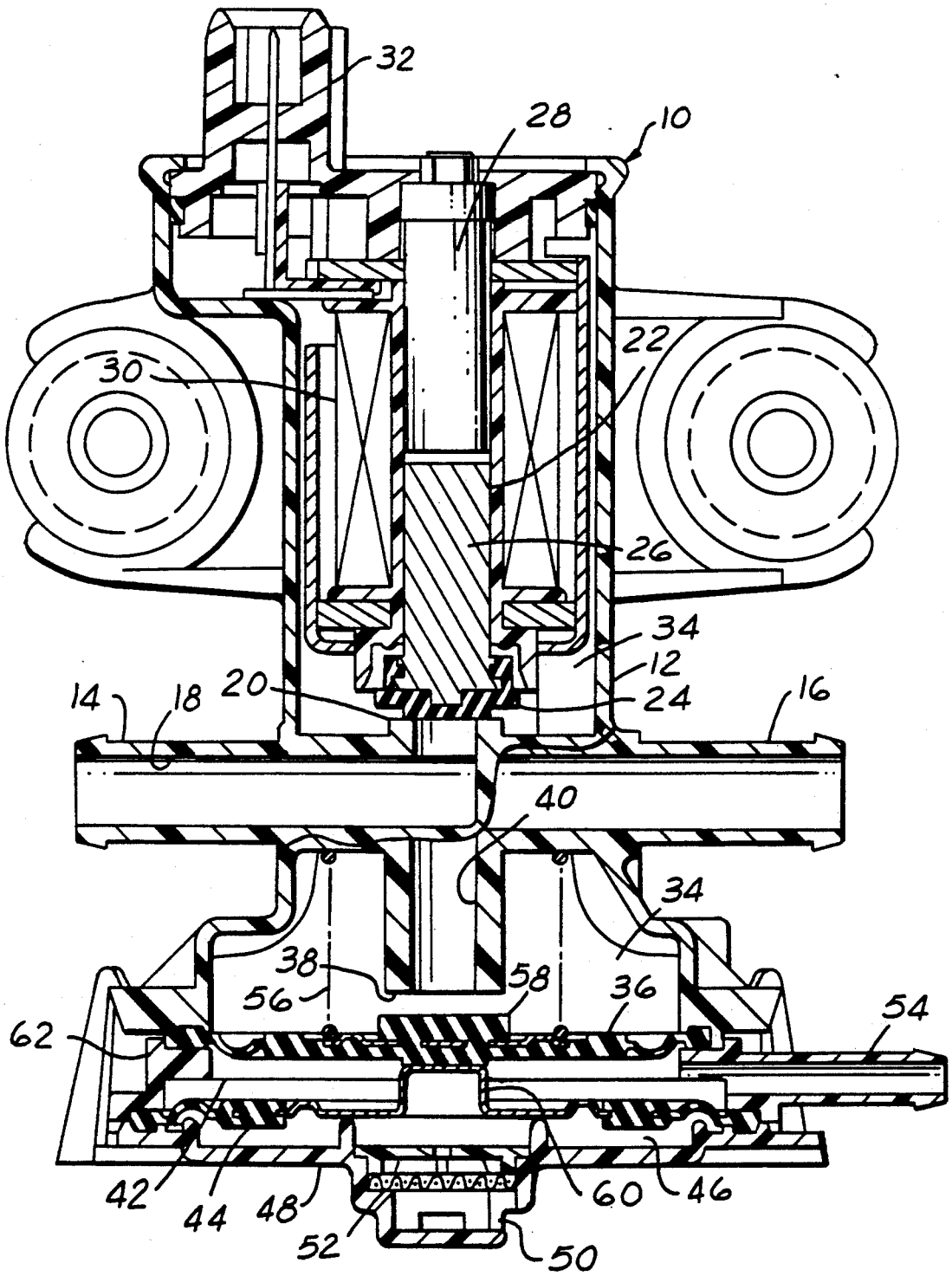
FIG. 1 is a longitudinal cross sectional view through a multi-slope CPS valve embodying principles of the invention.

FIG. 1 shows a multi-slope CPS valve 10 which comprises a body 12, an inlet 14, and an outlet 16. When CPS valve 10 is installed in an evaporative emission control system such as the one shown in FIG. 2, inlet 14 is connected to an evaporative emission collection canister, and outlet 16 is connected to an engine intake manifold. Inlet 14 comprises a passageway 18 leading to a circular valve seat 20 which confronts a solenoid-operated valve element 22. Valve element 22 comprises a sealing portion 24 that is on one end of an armature portion 26. The opposite end of armature portion 26 confronts a stator portion 28 of a solenoid coil 30. The solenoid coil has an electrical connector 32 for operatively connecting it, as portrayed in FIG. 2, to electrical circuitry which selectively energizes it. Valve element 22 is resiliently biased toward seat 20 and the attendant closure of the flow path from inlet 14 to outlet 16. When solenoid coil 30 is energized, the valve element is unseated to open the flow path. Typically, the solenoid coil is energized by a pulse width modulated (PWM) waveform so that the extent to which the valve opens is a function of the pulse width of the energizing waveform.

With valve element 22 unseated from seat 20, flow from inlet 14 can continue through an interior chamber space 34 within body 12. One axial end of chamber space 34, the lower end as viewed in FIG. 1, is closed by a movable wall, or diaphragm, 36. Within chamber space 34, a central region of diaphragm 36 is confronted by a valve seat 38 that is at one end of a passageway 40 leading to outlet 14. A second chamber space 42 is cooperatively defined by diaphragm 36 and a second diaphragm 44. A third chamber space 46 is cooperatively defined by diaphragm 44 and a closure 48 at the lower end of body 12. Closure 48 contains a vent 50, including a filter 52, for venting chamber space 46 to atmosphere. Chamber space 42 is communicated via a nipple 54 to intake manifold vacuum. Chamber space 42 is totally enclosed except for the communication that is provided via nipple 54 whereby the sole means of fluid ingress to and egress from chamber space 42 is via the nipple. A helical coil spring 56 acts between an internal wall portion of body 12 and diaphragm 36 to resiliently bias the latter in a direction away from valve seat 38. The central region of diaphragm 36 contains within chamber space 34 a valve element 58 that is adapted for coaction with seat 38. A central region of diaphragm 44 contains a stem 60 that projects with chamber space 42 toward, and for coaction with, the central region of diaphragm 36. The area of diaphragm 44 is made slightly larger than that of diaphragm 36.

When the engine is not operating, solenoid coil 30 is not energized and thus the flow path through CPS valve 10 is closed by virtue of valve element 22 seating on seat 20. Concurrently, the three chamber spaces 34, 42, and 46 are at atmospheric pressure. For this condition, spring 56 forces diaphragm 36 against the tip of stem 60, and both diaphragms downwardly, to where diaphragm 44 bottoms out on the inside of closure 48.

When the engine is operating, manifold vacuum is delivered to both chamber spaces 34 and 42. The atmospheric pressure in chamber space 46 will therefore urge both diaphragms upwardly, increasingly compressing spring 56 in the process. Stem 60 maintains a spacing distance between central regions of the two diaphragms. The extent to which the diaphragms are displaced is a function of the intensity of manifold vacuum. Basically, the combined effect of the two diaphragms is to create a series of flow-rate vs. duty-cycle slopes, each of which defines the flow-rate vs. duty-cycle function for a corresponding intensity of intake manifold vacuum. Representative slopes are displayed on the graph of FIG. 3.

The construction of CPS 10 is cost-effective in comparison to the regulated CPS described earlier in that valve 10 includes only the additional parts: diaphragm 44, a spacer 62 which contains nipple 54, and closure 48 which substitutes for a body-attached closure that cooperated with diaphragm 44 to form an atmospheric chamber space in the regulated CPS valve.

While a presently preferred embodiment of the invention has been illustrated and described, it should be appreciated that principles are applicable to other embodiments.

What is claimed is:

1. In an automotive internal combustion engine canister purge system wherein a canister purge solenoid (CPS) valve has an inlet connected to a canister that is to be purged of collected fuel vapors, an outlet connected to intake manifold vacuum, a flow path between said inlet and said outlet which includes a solenoid-controlled valve and a diaphragm-controlled valve, in that order, between said inlet and said outlet, said diaphragm-controlled valve comprising diaphragm means having one face disposed for valved communication with said outlet and another face disposed for communication with atmosphere characterized in that said diaphragm means comprises two diaphragms that are separated by a chamber space, one of said diaphragms containing said one face and the other of said diaphragms containing said another face, and said chamber space is communicated to intake manifold vacuum.

2. A system as set forth in claim 1 characterized further in that said chamber space is totally enclosed such that the sole means for ingress and egress of fluid thereto and therefrom is to and from intake manifold vacuum.

3. A system as set forth in claim 2 characterized further in that the area of said other diaphragm is slightly larger than that of said one diaphragm.

4. A system as set forth in claim 1 characterized further in that the area of said other diaphragm is slightly larger than that of said one diaphragm.

5. A system as set forth in claim I characterized further in that a first of said diaphragms comprises a stem that provides spacing between central regions of said two diaphragms.

6. A system as set forth in claim 5 characterized further in that said first of said diaphragms is said one diaphragm.

7. A canister purge solenoid (CPS) valve having an inlet for connection to a canister that is to be purged of collected fuel vapors, an outlet for connection to intake manifold vacuum, a flow path between said inlet and said outlet which includes a solenoid-controlled valve and a diaphragm-controlled valve, in that order, between said inlet and said outlet, said diaphragm-controlled valve comprising diaphragm means having one face disposed for valved communication with said outlet and another face disposed for communication with atmosphere characterized in that said diaphragm means comprises two diaphragms that are separated by a chamber space, one of said diaphragms containing said one face and the other of said diaphragms containing said another face, and said chamber space is communicated to intake manifold vacuum.

8. A CPS valve as set forth in claim 7 characterized further in that said chamber space is totally enclosed such that the sole means for ingress and egress of fluid thereto and therefrom is to and from intake manifold vacuum.

9. A CPS valve as set forth in claim 8 characterized further in that the area of said other diaphragm is slightly larger than that of said one diaphragm.

10. A CPS valve as set forth in claim 7 characterized further in that the area of said other diaphragm is slightly larger than that of said one diaphragm.

11. A CPS valve as set forth in claim 7 characterized further in that a first of said diaphragms comprises a stem that provides spacing between central regions of said two diaphragms.

12. A CPS valve as set forth in claim 11 characterized further in that said first of said diaphragms is said one diaphragm.

* * * * *